US005101762A

United States Patent [19]

Nakade

[11] Patent Number: 5,101,762

[45] Date of Patent: Apr. 7, 1992

[54] SIZING MACHINE

[75] Inventor: Kiyoshi Nakade, Komatsu, Japan

[73] Assignee: Tsudakoma Corporation, Ishikawa, Japan

[21] Appl. No.: 623,616

[22] Filed: Dec. 7, 1990

[30] Foreign Application Priority Data

Dec. 8, 1989 [JP] Japan ..... 1-319928

[51] Int. Cl.[5] ..... B05C 3/12

[52] U.S. Cl. ..... 118/667; 118/688; 118/419

[58] Field of Search ..... 118/666, 667, 672, 674, 118/688, 689, 693, 419

[56] References Cited

U.S. PATENT DOCUMENTS 3,172,779 3/1965 Warsaw et al. ..... 118/694
3,237,593 3/1966 Trotter ..... 118/694
3,425,861 2/1969 Jones ..... 118/694
3,605,682 9/1971 Groce et al. ..... 118/694
3,862,553 1/1975 Schwemmer et al. ..... 118/672
4,607,944 8/1986 Rushing ..... 118/688
4,947,501 8/1990 Koch ..... 118/694

*Primary Examiner*—Willard E. Hoag
*Attorney, Agent, or Firm*—Wenderoth, Lind & Ponack

[57] ABSTRACT

A sizing machine capable of maintaining a sizing liquid at a desired temperature by controlling the supply of steam into a cavity box containing the sizing liquid is provided with a sizing liquid consumption measuring system capable of accurately measuring a sizing liquid consumption. The sizing liquid consumption measuring system measures a sizing liquid consumption automatically by measuring the quantity of water added to the sizing liquid contained in the cavity box by steam supplied into the cavity box, and the level of the sizing liquid in the cavity box.

4 Claims, 5 Drawing Sheets

SIZING MACHINE

BACKGROUND OF THE INVENTION

1. Field of the Invention

The present invention relates to a sizing machine and, more specifically to means for measuring the consumption of a sizing liquid during sizing operation.

2. Description of the Related Art

A sizing machine determines a sizing liquid consumption through the measurement of a change in the level of the sizing liquid in the cavity box, and the measured sizing liquid consumption is used for calculating size percentage and for regulating the pressure of the squeezing roller.

Steam is blown directly into the cavity box containing the sizing liquid to maintain the sizing liquid at a constant temperature. The steam blown into the cavity box to heat the sizing liquid changes into water to increase the quantity of the sizing liquid and to reduce the concentration of the sizing liquid more or less.

When steam is blown into the cavity box, the level gage measures the level of the sizing liquid resulting from the compensation of a decrement in the quantity of the sizing liquid due to consumption by an increment in the quantity of the same due to addition of water by the steam to the sizing liquid. Accordingly, the quantity of the water produced by the condensation of the steam blown into the cavity box is a direct error in size consumption, hence the size percentage, determined through the measurement of the level of the sizing liquid in the cavity box has an error and affects adversely to the control of slashing operation.

SUMMARY OF THE INVENTION

Accordingly, it is an object of the present invention to determine sizing liquid consumption accurately through the measurement of the level of the sizing liquid taking into consideration an increment in the level due to the supply of steam into the cavity box containing the sizing liquid.

To achieve the object, in one aspect of the present invention, a time in which steam is blown into the cavity box containing the sizing liquid during the drop of the given level of the sizing liquid is measured to obtain a total steam blowing time, an added quantitiy of water is calculated on the basis of the total steam blowing time and the flow rate of steam blown into the cavity box, namely, the quantity of water added to the sizing liquid in a unit time, and the added quantity of water is added to a decrement of the sizing liquid calculated on the basis of a change in the level of the sizing liquid to determine a sizing liquid consumption accurately.

In another aspect of the present invention, the total quantity of steam blown into the cavity box containing the sizing liquid during a period in which a given level of the sizing liquid changes is measured by a flowmeter, an added quantity of water is calculated on the basis of the total quantity of steam blown into the cavity box, the added quantity of water is added to a decrement in the quantity of the sizing liquid calculated on the basis of a change in the level of the sizing liquid to determine an accurate sizing liquid consumption. When the steam has a high wetness, the wetness of the steam is taken into consideration in calculating the added quantity of water.

Thus, the present invention measures the added quantity of water added in the form of steam blown into the cavity box while the sizing liquid is consumed, and determines the sizing liquid consumption by adding the added quantity of water to the decrement of sizing liquid determined on the basis of a variation in the sizing liquid level, so that the sizing liquid consumption can be accurately determined. Accordingly, the pressure of the squeezing roller can be accurately controlled on the basis of the sizing liquid consumption and hence stable sizing operation can be carried out.

The above and other objects, features and advantages of the present invention will become more apparent from the following description taken in conjunction with the accompanying drawings.

DETAILED DESCRIPTION OF THE PREFERRED EMBODIMENTS

Figure 1:
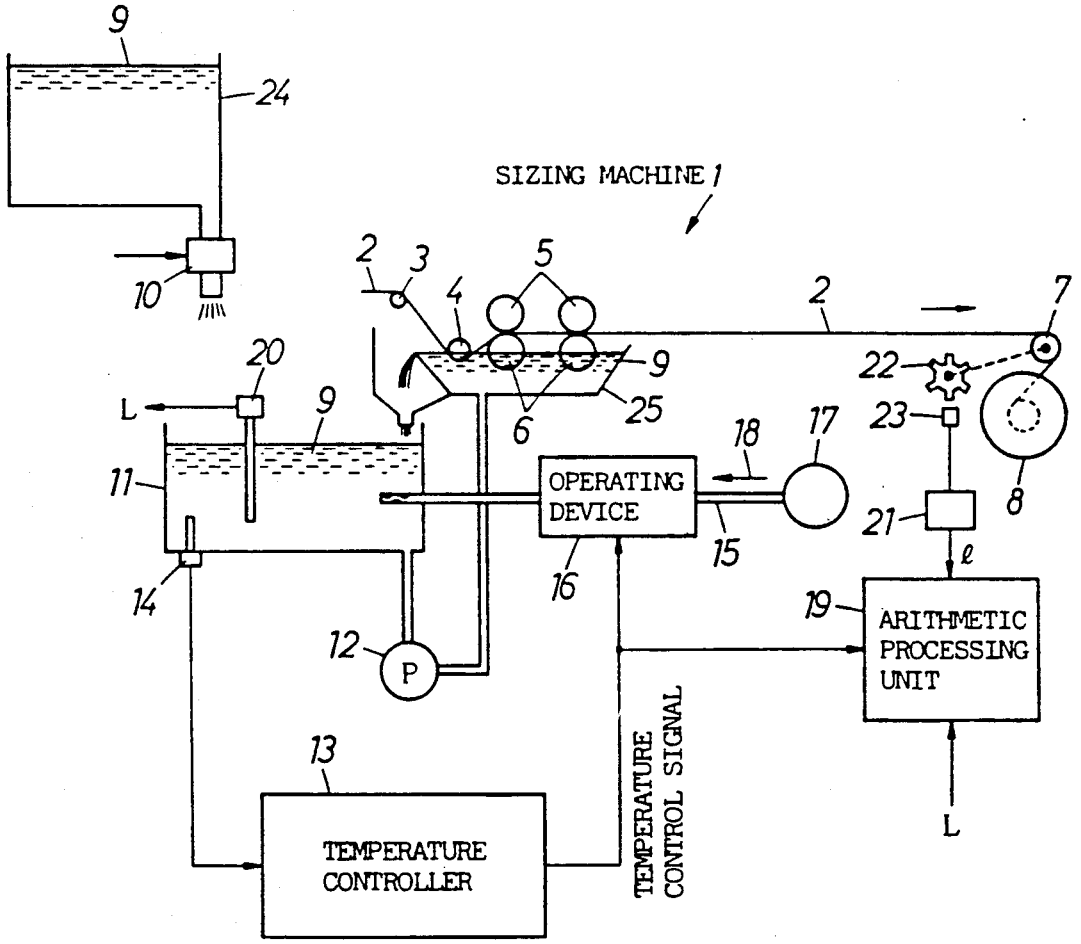
FIG. 1 is a block diagram of a sizing machine.
Figure 2:
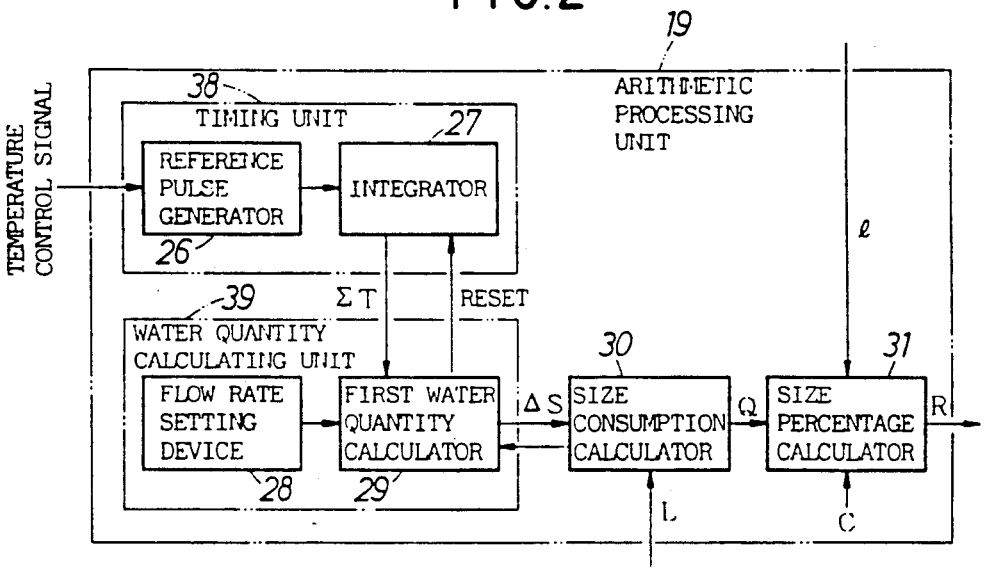
FIG. 2 is a block diagram of an arithmetic processing unit.
Figure 3:
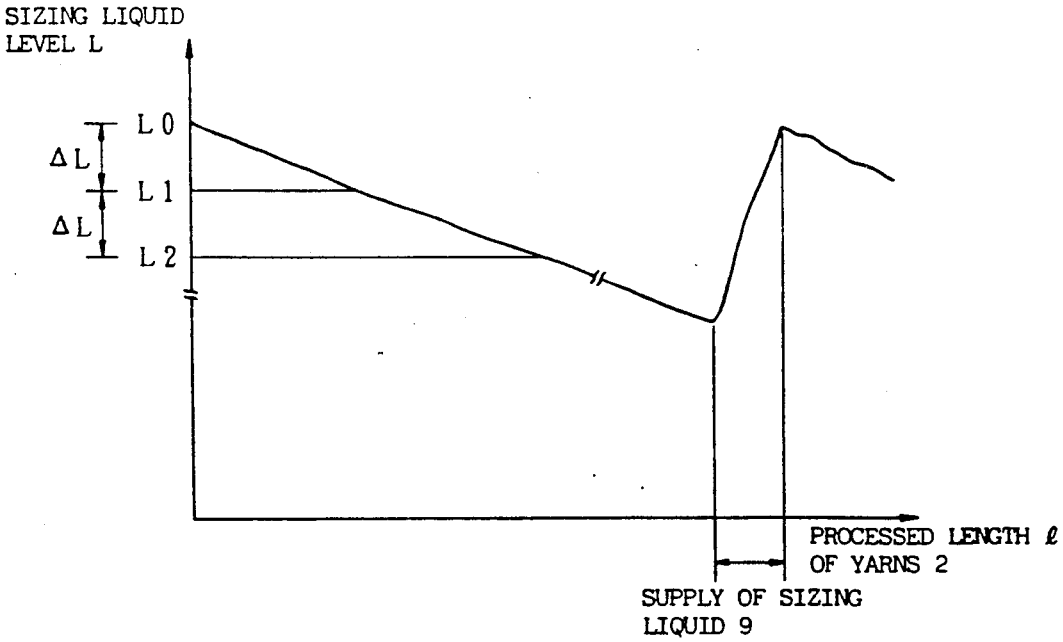
FIG. 3 is a graph showing the variation of sizing liquid level with the length of sized yarns.

First Embodiment (FIGS. 1 to 3)

FIG. 1 shows the general construction of a sizing machine 1 in a preferred embodiment according to the present invention.

A plurality of parallel yarns 2 arranged in a sheet are guided for sizing into a sizing box 25 by guide rollers 3 and 4, and the sized yarn 2 are squeezed between two pairs each of a sizing roller 6 and a squeezing roller 5 pressed against the sizing roller 6. The sized yarns 2 dried by a drying unit, not shown, are guided by a guide roller 7 to a takeup beam 8 and are wound on the takeup beam 8. The sizing rollers 6 are partially dipped in a sizing liquid contained in the sizing box 25 and are rotated together with the squeezing rollers 5 to impregnate the yarns 2 with the sizing liquid 9. The size percentage of the yarns 2 is regulated by controlling the pressure of the squeezing rollers 5.

When the sizing liquid level L in a cavity box 11 detected by a level detector 20 descends below a limit level during the sizing operation, a controller, not shown, gives a command to make the sizing liquid level L in the cavity box 11 ascend to a reference sizing liquid level L0 by supplying the sizing liquid 9 of a given size concentration through a shut-off valve 10 into the cavity box 11. A pump 12 supplies into the sizing liquid 9 continuously at a flow rate exceeding a sizing liquid consumption rate at which the sizing liquid 9 contained in the sizing box 25 is consumed, so that the excessive sizing liquid 9 overflows the sizing box 25 and returns into the cavity box 11 and the sizing liquid level in the sizing box 25 remains constant.

While the sizing liquid is thus circulated through the cavity box 11 and the sizing box 25, the sizing liquid 9 contained in the cavity box 11 is maintained at a desired temperature by a temperature controller 13. While the sizing liquid 9 is circulated, an electrical temperature detector 14 provided, for example, in the cavity box 11 detects the temperature of the sizing liquid 9 and gives a detection signal to the temperature controller 13. Then, the temperature controller 13 provides a temperature control signal according to the deviation of the measured temperature from the desired temperature and controls an operating device 16, such as a solenoid valve, provided in a steam supply passage 15 so that steam 18 is supplied from a steam supply source 17 through the steam supply passage 15, for example, into the cavity box 11 for a time necessary to reduce the deviation to zero. The sizing liquid 9 is heated directly by steam 18 and the temperature of the sizing liquid 9 approaches the desired temperature. Upon the coincidence of the temperature of the sizing liquid 9 with the desired temperature, the temperature controller 13 stops providing the temperature control signal and, consequently, the operating device 16 stops supplying steam 18 into the cavity box 11. Thus, the temperature controller 13 controls the operating device 16 so as to supply steam 18 into the cavity box 11 every time the deviation of the temperature of the sizing liquid 9 from the desired temperature exceeds a given value to maintain the temperature of the sizing liquid at the desired temperature. As stated above, the steam 18 supplied into the cavity box 11 supplies water as well as heat, whereby the quantity of the sizing liquid 9 increases temporarily.

During the sizing operation, an arithmetic processing unit 19 receives a sizing liquid level signal L provided by a sizing liquid level detector 20, a temperature control signal provided by the temperature controller 18 and the output signal of a pulse counter 21 as input signals and calculates a sizing liquid consumption Q and a size percentage R on the basis of those input signals. The pulse counter 21 is connected to a proximity switch 23 for detecting a processed length l of the yarns 2. The proximity switch 23 provides a pulse signal corresponding to the rotation of a rotary member 22 interlocked, for example, with the guide roller 7.

As shown in FIG. 2, during the supply of steam 18 into the cavity box 11, namely, during the continuance of the temperature control signal provided by the temperature controller 13, a reference pulse generator 26 included in a timing unit 38 applies a reference pulse stream to an integrator 27. The integrator 27 counts the number of pulses of the reference pulse stream during the continuance of the temperature control signal. The number of pulses of the reference pulse stream counted by the integrator 27 represents the duration of operation of the operating device 16 for supplying steam into the cavity box 11, namely, a steam supply time ΣT. The duration of a steam supply state of the operating device 16 may be directly measured. Upon the reception of a request signal from a sizing liquid consumption calculator 30, a first water quantity calculator 29 receives a ΣT signal representing the current steam supply time ΣT from the integrator 27, multiplies the steam supply time ΣT by a given water volume flow rate, a value representing the quantity of water to be supplied in the from of steam in a unit time, set by a flow rate setting device 28 to obtain the quantity ΔS of water supplied in the form of steam into the cavity box 11 and applies a ΔS signal representing the quantity ΔS of water to the sizing liquid consumption calcurator 30. Upon the reception of the ΣT signal, the first water quantity calcurator 29 resets the integrator 27. The water volume flow rate is a predetermined volume of water supplied in the form of steam into the cavity box 11 during the steam supply operation of the operating device 16 for a unit time.

When a sizing liquid level L1 of the sizing liquid 9 contained in the cavity box 11 descends by a given level drop ΔL to a sizing liquid level L2 as shown in FIG. 3, the sizing liquid consumption calculator 30 gives a request signal to the first water quantity calculator 29 to receive the ΔS signal and calculates a sizing liquid consumption Q on the basis of the Δs signal and the level drop ΔL (=L1−L2) by using a formula:

$$Q=\Delta L\times K+\Delta S$$

where K is the bottom area of the cavity box 11.

When necessary, a size percentage calculator 31 calculates a size persentage R on the basis of necessary data including the processed length l of the yarns 2 and the concentration C of the sizing liquid by using a formula:

$$R=Ws/Ww$$

where Ws is the weight of the sizing liquid carried away by the yarns 2 and Ww is the weight of the yarns 2 processed for sizing. In the description of the first and second embodiments of the present invention, it is supposed for simplicity that the concentration C of the sizing liquid 9 contained in the cavity box 11 remains constant after steam is supplied into the cavity box 11.

The weight Ws of the sizing liquid taken up by the yarn 2 is a function of the sizing liquid consumption Q, the specific gravity ρ of the sizing liquid and the concentration C of the sizing liquid, and the weight Ww of the processed yarns 2 is a function of the length (yards) of the processed yarns 2, the number N of the yarns 2, the count (cotton count) E of the yarns 2 and constants (840 and 2.2). Therefore, $$R=(\Delta L\times K\times\rho+\Delta S\times 1)\times C/\{(\times N)/(840\times E\times 2.2-)\}$$

Figure 4:
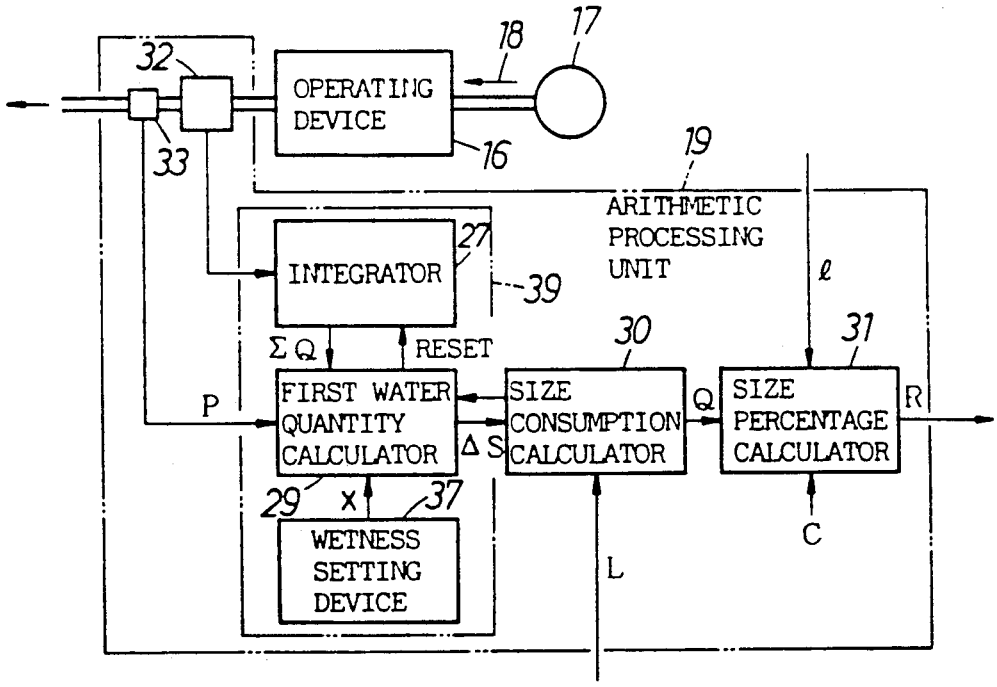
FIG. 4 is a block diagram of an arithmetic processing unit.

Second Embodiment (FIG. 4)

A sizing machine in a second embodiment employs a flowmeter for measuring the flow rate of steam 18.

As shown in FIG. 4, a flowmeter 32, such as a piezoelectric digital flowmeter or an electromagnetic flowmeter, and a pressure sensor 33 are provided after an operating device 16 with respect to the direction of flow of steam. An integrator 27 calculates the total quantity ΣQ of steam supplied into the cavity box 11 on the basis of measurements obstained by the flowmeter 32. Upon the reception of a request signal from a sizing liquid consumption calculator 30, a first water quantity calculator 29, similarly to the first water quantity calcurator 29 employed in the first embodiment, receives the total quantity ΣQ from the integrator 27, rests the integrator 27, receives a wetness signal representing the wetness X of steam from a wetness setting device 37 and a pressure signal representing the pressure P of steam from the pressure sensor 33, calculates a quantity ΔS of water supplied into the cavity box 11, and then gives the quantity ΔS to the sizing liquid consumption calculator 30. When the pressure P of steam is stable, the sensors may be omitted and a fixed specific volume may be used.

The sizing liquid consumption calculator 30 calculates a sizing liquid consumption Q and, when necessary, a size percentage calculator 31 calculates a size percentage R.

Third embodiment (FIGS. 5 to 8)

Figure 6:
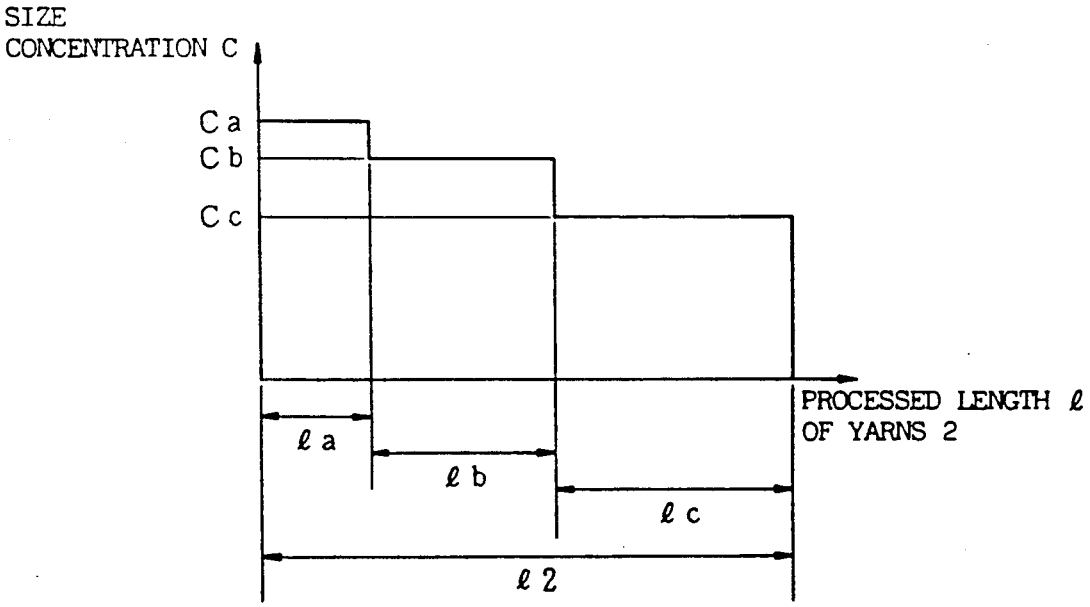
FIG. 6 is a graph showing the variation of size concentration with the length of sized yarns.
Figure 7:
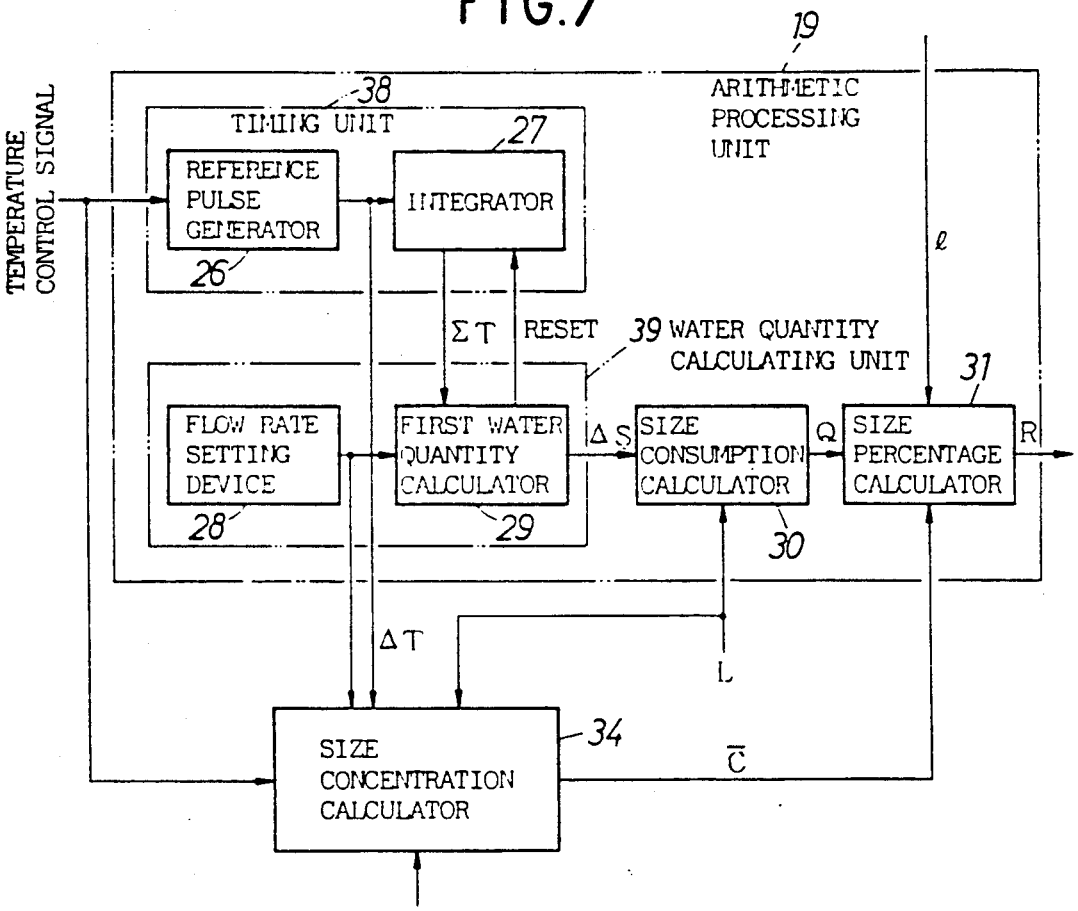
FIG. 7 is a block diagram showing the connection of a size concentration calculator with other calculators.
Figure 8:
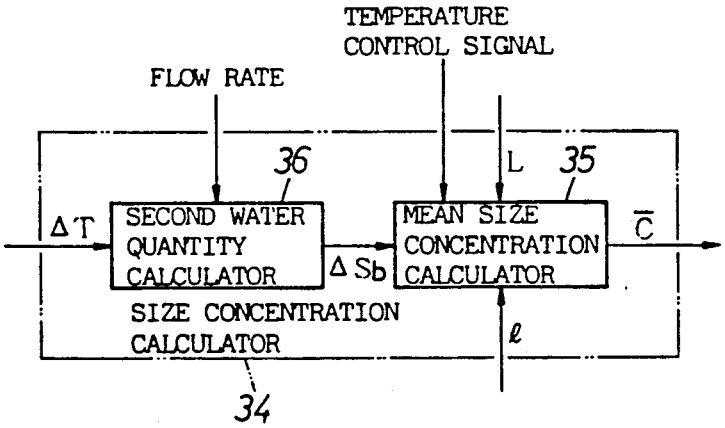
FIG. 8 is a block diagram of the size concentration calculator.

In the first and second embodiments, it is suppposed that the size concentration C is constant in determining a size percentage R through the measurement of the variation of the sizing liquid level from L0 to L1 and from L1 to L2. Actually, the size concentration C decreases more or less as shown in FIG. 6 when steam is supplied into the cavity box 11. Therefore, it is preferable to use a mean size concentration $\overline{C}$ for determining a sizing liquid consumption Q and a size percentage R during the variation of the sizing liquid level L. In the third embodiment, a size concentration calculator 34 calculates sequentially size concentrations Cb and Cc of the sizing liquid 9 after steam has been supplied into the cavity box 11 each time a temperature controller 13 provides a temperature control signal, namely, each time the operating device 16 functions as shown in FIGS. 7 and 8. Eventually, a mean size concentration $\overline{C}$ during the change of the sizing liquid level L by a given value is obtained.

Figure 5:
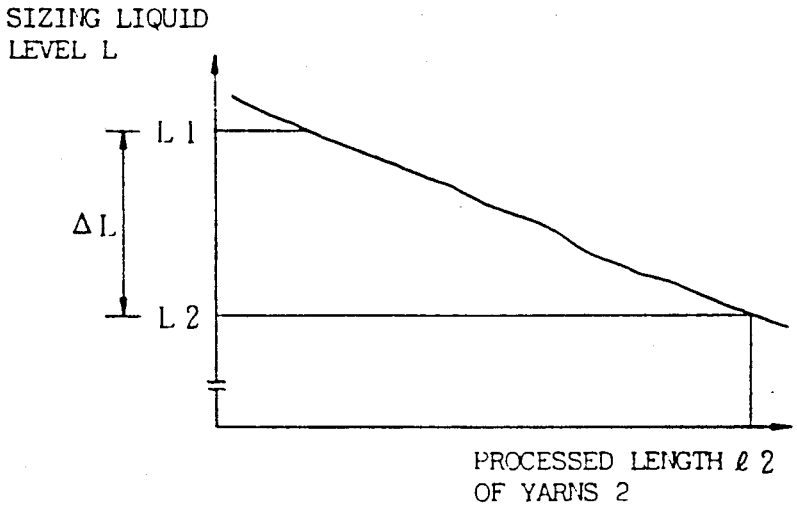
FIG. 5 is a graph showing the variation of sizing liquid level with the length of sized yarns.

Suppose that the sizing liquid 9 has a sizing liquid level L1 at the start of the sizing operation as shown in FIG. 5 and a first temperature control signal is provided when the sizing liquid level reaches a sizing liquid level Lb. Then, a sizing liquid level detector 20 gives a signal representing the sizing liquid level Lb to a mean size concentration calculator 35 included in the size concentration calculator 34. A second water quantity calculator 36 included in the size concentration calculator 34 receives a pulse stream generated by a reference pulse generator 26 during the continuance of the temperature control signal, calculates an added quantity ΔSb of water on the basis of an operation time ΣT of the operating device 16 and the steam flow rate at the completion of each temperature control cycle of the operating device 16 controlled by the temperature control signal, and then gives the added quantity ΔSb of water to the mean size concentration calculator 35. Then, the mean size concentration calculator 35 determines a size concentration Cb at the end of the supply of steam on the basis of the added quantity ΔSb of water and a size concentration Ca determined in the preceding temperature control cycle by using a formula:

$$Cb = \{(\text{Wt. of sizing liquid immediately before steam supply})/(\text{Wt. of sizing liquid immediately after steam supply})\} \times Ca = \{(T + L_b \times K) \times \rho \times C_a)/(T + L_b \times K) \times \rho + \Delta S_b \times 1$$

where T is the quantity of the sizing liquid circulating outside the cavity box 11.

The size concentration Cb is integrated with respect to the length lb of the yarns 2 processed between a first temperature control signal and a second temperature control signal, and the integral of the size concentration is stored. Naturally, the size concentration Ca and the length la of the processed yarns 2 before the first temperature control signal are integrated and the integrals of the same are stored. The integration is performed each time the temperature control signal is provided. When the sizing liquid level descends to a sizing liquid level L2, a mean size concentration $\overline{C}$ during a period in which the sizing liquid level changed from L1 to L2 and the yarns 2 are processed by a length l2 is calculated by a formula:

$$i\,\overline{C} = (Ca \times la + Cb \times lb + Cc \times lc)/l22$$

On the other hand, when the sizing liquid level of the sizing liquid 9 reached the sizing liquid level L2, a size percentage calculator 31 calculates a mean size percentage R1 on the basis of the means size concentration $\overline{C}$, the weight W2 of the yarns processed during the temperature control cycle (the product of the length l2 and the weight of the yarns per unit length) by using the formula employed in the first embodiment.

Although the mean size concentration C can be most accurately determined by such a procedure, it is also possible to use a simple mean size concentration obtained by calculating a water quantity increment ΔS and calculating a size concentration C by using the water quantity increment ΔS each time the sizing liquid level L changes by a level differential L0, and by averaging {(L1−L2)/} L0 pieces of size concentration C. It is also possible to use a mean size concentration obtained by calculation: (CaO+Cal)/2, where CaO is an initial size concentration, and Cal is a size concentration when the sizing liquid level is La and steam is supplied into the cavity box 11 to add a water quantity increment ΔS (=ΔSa +ΔSb+ΔSc) to the sizing liquid 9. The water quantity increment Δs is calculated by the first water quantity calculator 29.

A size concentration Ck of the sizing liquid 9 contained in the cavity box 11 after the new sizing liquid 9 has been supplied from as reserve box 24 through the shut-off value 10 is determined by calculating a quantity A of the new sizing liquid 9 supplied to the cavity box 11 from the addition of a change in the quantity of the sizing liquid corresponding to a change in the sizing liquid level L during the supply of the new sizing liquid 9 and a sizing liquid consumption during the supply of the new sizing liquid 9, and calculating the size concentration Ck on the basis of the quantity A of the new sizing liquid 9 supplied to the cavity box 11, the sizing liquid level L before the supply of the new sizing liquid 9 into the cavity box 11, and the size concentration C before the supply of the new sizing liquid 9 into the cavity box 11. The sizing liquid consumption during the supply of the new sizing liquid 9 is estimeted on the basis of the length Δk of the yarns 2 processed during the supply of the new sizing liquid 9 and the size percentage R determined before the supply of the new sizing liquid 9.

Although the sizing machine 1 in any one of the foregoing embodiments replenishes the cavity box 11 with the new sizing liquid 9 upon the descent of the sizing liquid level L in the cavity box 11 to a given level, it is also possible to maintain a fixed sizing liquid level L by supplying the new sizing liquid 9 from the reserve box 24 into the cavity box 11 each time liquid level L in the cavity box 11 descends slightly. In the latter case, a sizing liquid consumption Q may be determikned by intergrating a flow rate signal Qk provided by a flowmeter 32 provided after the shut-off valve 10 in a sizing liquid supply passage instead of using the signal representing the sizing liquid level L and provided by the sizing liquid consumption calculator 30, giving a request signal to the first water quantity calculator 29 upon the coincidence of an integral ΣQk with a given quantity Qk0, and adding a water quantity increment ΔS calculated by the first water quantity calculator 29 to the quantity QK0. The integrator 27 provides a signal representing the water quantity increment S provided by steam supplied into the cavity box 11 while the sizing liquid 9 of the given quantity QK0 is supplied into the cavity box 11, namely, the water quantity increment ΔS provided by steam supplied into the cavity box 11 in a period in which the sizing liquid level L has descended byu a value corresponding to the quantity QK0. In this case, the sizing liquid consumption is determined indirectly through the integration flow rate of the sizing liquid supplied when the sizing liquid level L changes with respect to time instead of directly determining the sizing liquid consumption on the basis of the change of the sizing liquid level L. In either case, the sizing liquid consumption can be determined through the detection of the change of the sizing liquid level L.

Although the invention has been described in its preferred form with a certain degree of paticularity, it is to be understood that many variations and changes are possible in the invention without departing from the scope thereof.

What is claimed is:

1. A sizing machine for sizing a plurality of parallel yarns arrenged in a sheet by passing the yarns between squeeze rollers and sizing rollers partially immersed in a sizing liquid contained in a cavity box; comprising: a temperature detector provided in a circulation passage through which the sizing liquid is circulated to detect the temperature of the sizing liquid; and a temperature controller which controls an operating device provided in a steam supply passage so that steam is supplied into the cavity box to heat the sizing liquid according to the deviation of the temperature of the sizing liquid from a desired temperature; the improvement comprising an arithmetic processing unit capable of determining a sizing liquid decrement on the basis of the change of the level of the sizing liquid in the cavity box; of determining the quantity of water added to the sizing liquid by the steam supplied into the cavity box to control the temperature of the sizing liquid and of calculating a sizing liquid consumption by processing a value obtained by adding the quantity of water added to the sizing liquid to the sizing liquid decrement.

2. A sizing machine according to claim 1, wherein said arithmetic processing unit comprises: a timing unit for measuring a steam supply time in which steam is blown into the sizing liquid contained in the cavity box; a water quantity calculating unit for calculating the quantity of water added to the sizing liquid contained in the cavity box by the steam supplied into the cavity box on the basis of the steam supply time measured by the timing unit and a water supply rate; and a sizing liquid consumption calculator for determining a sizing liquid consumption by determining a sizing liquid decrement of the basis of the change of the level of the sizing liquid in the cavity box and adding the quantity of water added to the sizing liquid contained in the cavity box to the sizing liquid decrement, and for providing a signal representing the sizing liquid consumption.

3. A sizing machine according to claim 1, wherein said arithmetic processing unit comprises: a flowmeter provided in the steam supply passage; a water quantity calculating unit for calculating the quantity of water added to the sizing liquid contained in the cavity box by the steam supplied into the cavity box by integrating the flow rate of steam measured by the flowmeter with respect to time; and a sizing liquid consumption calculator for determining a sizing liquid consumption by determining a sizing liquid decrement on the basis of the change of the level of the sizing liquid in the cavity box and adding the quantity of water added to the sizing liquid contained in the cavity box to sizing liquid decrement, and for providing a signal representing the sizing liquid consumption.

4. A sizing machine according to claim 1, wherein said arithmetic processing unit comprises a size percentage calculator for calculating a size percentage on the basis of a sizing liquid consumption, the length of the yarns sized and the concentration of the sizing liquid.

* * * * *